US010001329B2

(12) United States Patent
Gorza et al.

(10) Patent No.: US 10,001,329 B2
(45) Date of Patent: Jun. 19, 2018

(54) FIREARM WITH CHANGE CONFIGURATION DETECTION SYSTEM

(71) Applicant: FABBRICA D'ARMI PIETRO BERETTA S.p.A., Gardone Val Trompia, Brescia (IT)

(72) Inventors: Roberto Gorza, Belluno (IT); Eugenio Righi, Brescia (IT); Emilio Sardini, Brescia (IT)

(73) Assignee: FABBRICA D'ARMI PIETRO BERETTA S.p.A., Gardone Val Trompia, Brescia (IT)

( * ) Notice: Subject to any disclaimer, the term of this patent is extended or adjusted under 35 U.S.C. 154(b) by 0 days. days.

(21) Appl. No.: 15/501,724

(22) PCT Filed: Sep. 26, 2014

(86) PCT No.: PCT/IT2014/000255
§ 371 (c)(1),
(2) Date: Feb. 3, 2017

(87) PCT Pub. No.: WO2016/046850
PCT Pub. Date: Mar. 31, 2016

(65) Prior Publication Data
US 2017/0227310 A1 Aug. 10, 2017

(51) Int. Cl.
*F41A 9/53* (2006.01)
*F41A 17/72* (2006.01)
(Continued)

(52) U.S. Cl.
CPC ..... *F41A 9/53* (2013.01); *F41A 3/66* (2013.01); *F41A 17/72* (2013.01); *F41A 19/30* (2013.01); *F41C 3/00* (2013.01)

(58) Field of Classification Search
CPC ..... F41A 9/53
See application file for complete search history.

(56) References Cited

U.S. PATENT DOCUMENTS 5,465,518 A * 11/1995 Blaser ..... F41A 17/06 42/70.08
8,978,283 B2 * 3/2015 Brunner ..... F41A 17/06 42/70.05

(Continued)

FOREIGN PATENT DOCUMENTS

DE 10 2007 063 679 A1 9/2009
WO 2008/059506 A1 5/2008

OTHER PUBLICATIONS

International Search Report and Written Opinion of the International Searching Authority for corresponding International Patent Application No. PCT/IT2014/000255 dated Jun. 2, 2015, 8 pgs.

*Primary Examiner* — Stephen Johnson
*Assistant Examiner* — Joshua T Semick
(74) *Attorney, Agent, or Firm* — Merchant & Gould P.C.

(57) ABSTRACT

A firearm (1) includes a detection system (10) suitable to detect a configuration change of the firearm from an initial configuration. The detection system (10) includes a detection device (100), on the slide (20) suitable to be moved, starting from an initial position, to a detection position in which the detection device (100) detects a configuration change of the firearm. An idler device (200) on the slide (20) engages with the detection device (100) which moves the idler device (200). The detection device (200) includes at least one primary sensor element (250), a receiver device (300) on the main body (5) suitable to receive the information of the configuration change of the firearm from the primary sensor element (250) and at least a secondary sensor element (350).

18 Claims, 9 Drawing Sheets

(51) Int. Cl.

| | |
|---|---|
| ***F41A 19/30*** | (2006.01) |
| ***F41C 3/00*** | (2006.01) |
| ***F41A 3/66*** | (2006.01) |

(56) References Cited

U.S. PATENT DOCUMENTS

| | | | | |
|---|---|---|---|---|
| 2010/0139142 | A1 | 6/2010 | Pikielny | |
| 2016/0209141 | A1* | 7/2016 | Lampela | F41A 17/06 |

* cited by examiner

FIREARM WITH CHANGE CONFIGURATION DETECTION SYSTEM

This application is a National Stage Application of PCT/IT2014/000255, filed 26 Sep. 2014, and which application is incorporated herein by reference. To the extent appropriate, a claim of priority is made to the above disclosed application.

BACKGROUND OF THE INVENTION

The present invention relates to a firearm comprising a detection system suitable for detecting a configuration change of said firearm. In other words, the firearm is in an initial configuration in which, for example, it is not ready to fire; for the firearm to be ready to fire it is therefore necessary for the user or for an automated system inside the firearm, to perform a plurality of operations, in which the firearm is subject to the modification of said initial configuration and is placed in one or more new configurations. The detection system comprised in the firearm is thus suitable to detect such configuration changes of the firearm from its initial configuration. By way of example, one such configuration change may be the release of the safety catch.

Detection systems are known of in the prior art suitable to detect and report to the user a configuration change of the firearm. Such known detection systems are generally of the mechanical type and for example make a protrusion or specific signalling element, from the firearm, in the case of such configuration change, such as a "flag".

However, these detection systems are not able to perform such detection and to manage such information, for example, storing it or transmitting it. To perform such types of operation a special hardware, for example of the electronic type, is obviously required.

The main problem of such type of detection system lies in the risk that these are influenceble and/or influenced by the movement of the firearm, in particular, of its moving parts.

In fact, depending on its positioning and its dimensions said detection system influences the movement of the moving parts in general, as well as the movement of the moving parts in relation to the fixed parts. In other words, depending on its position and its dimensions, the detection system influences the dynamic behaviour of the firearm during firing, as well as the assembly and dismantling operations thereof, in particular the operation of dismantling the slide from the main body.

To minimise these problems the detection systems must have small dimensions especially as regards the components housed inside the moving parts.

In accordance with the above, is the added fact that the components of the electronic type, needed to manage the information concerning the configuration change, run the risk of being influenced, that is stressed and/or damaged, by the accelerations, typically impulsive, which the firearm undergoes subsequent to firing. In order to avoid such problems, said electronic devices are preferably located on the fixed parts of the firearm.

Special care must be taken, however, that the movement of the components inside the fixed parts must be performed so that material connections between the fixed and moving parts are avoided as far as possible so as to prevent, as said, complications in the reciprocal movement of said parts. The fixed parts and moving parts must continue to guarantee a specific reciprocal independence, so that in the use of the firearm they do not mutually influence each other.

SUMMARY OF THE INVENTION

The purpose of the present invention is to provide a firearm comprising a system for detecting the configuration change of the firearm able to overcome the aforesaid drawbacks.

BRIEF DESCRIPTION OF THE DRAWINGS

Moreover, the characteristics and advantages of the firearm and of the detection device will be evident from the description given below, made by way of a non-limiting example, with reference to the attached drawings, wherein:

FIG. 2 shows a perspective view of a transversal cross-section of the slide containing a part of the detection system comprised in the firearm which the present invention relates to;

Figure 1:
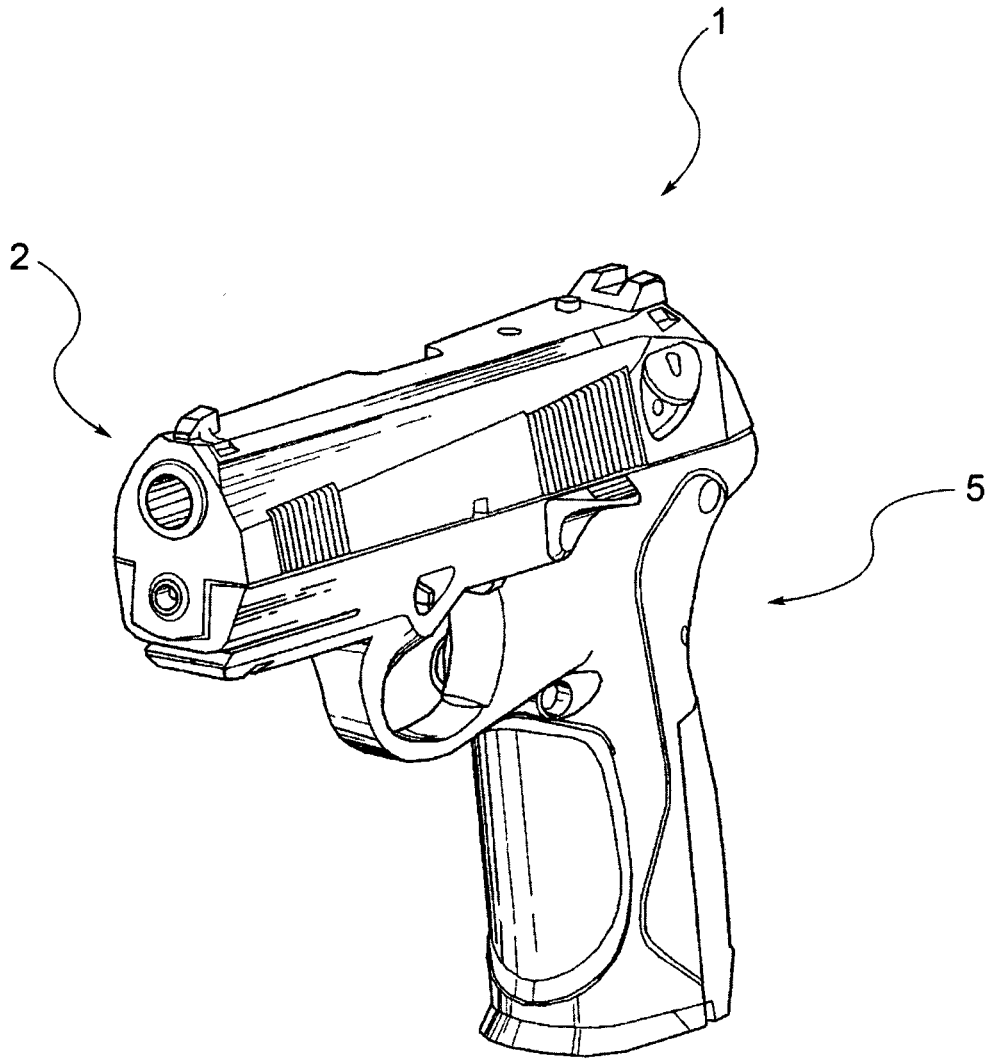
FIG. 1 is a perspective view of a firearm, in particular a gun, comprising within it a detection system of the configuration change of the firearm, according to a preferred embodiment.
Figure 2:
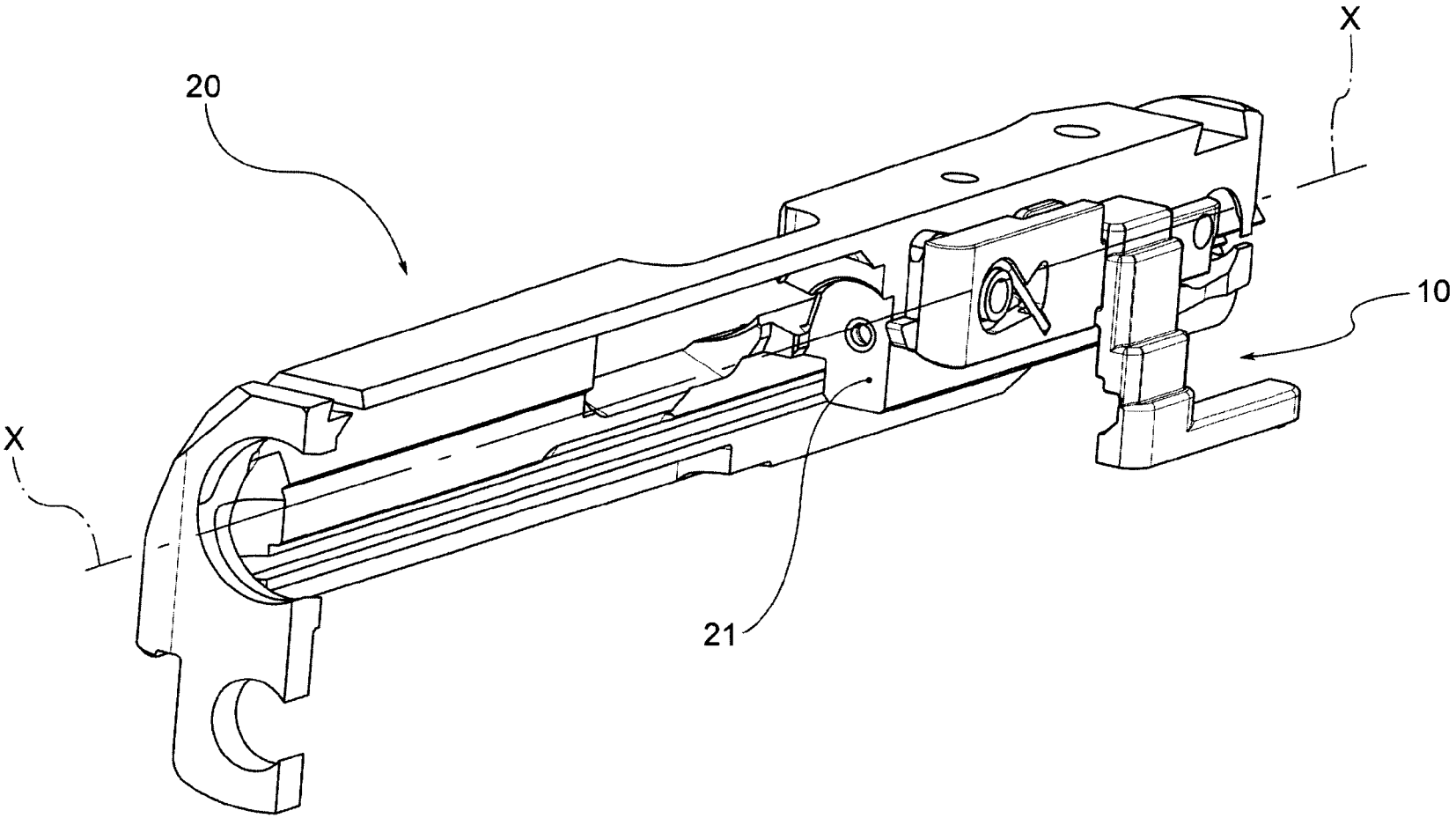
Figure 3:
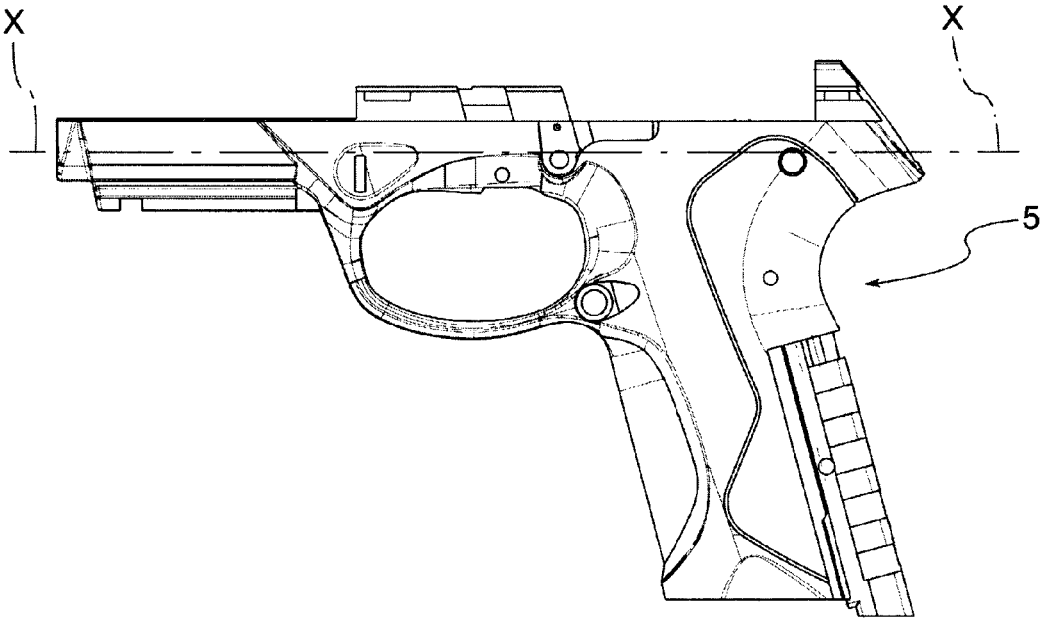
FIGS. 3 and 3*a* respectively show a side view and a plan view of the main body of the firearm according to FIG. 1 containing a further part of the detection system comprised in the firearm which present invention relates to, according to a preferred embodiment.
Figure 3A:
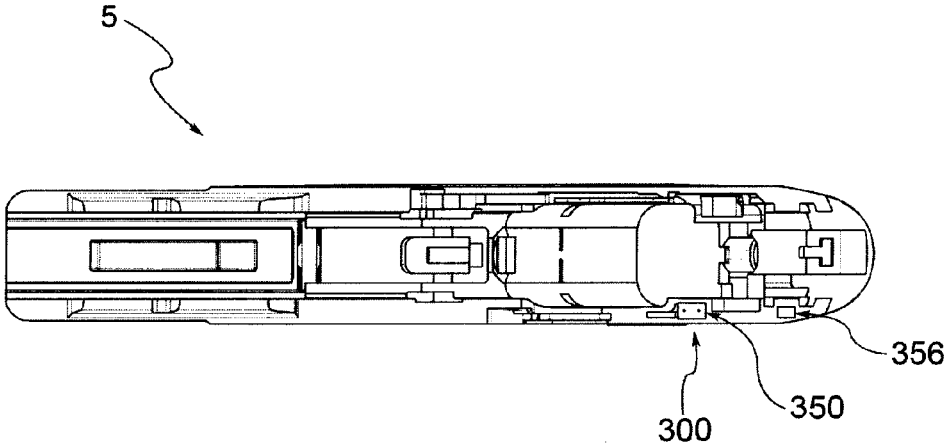
Figure 4:
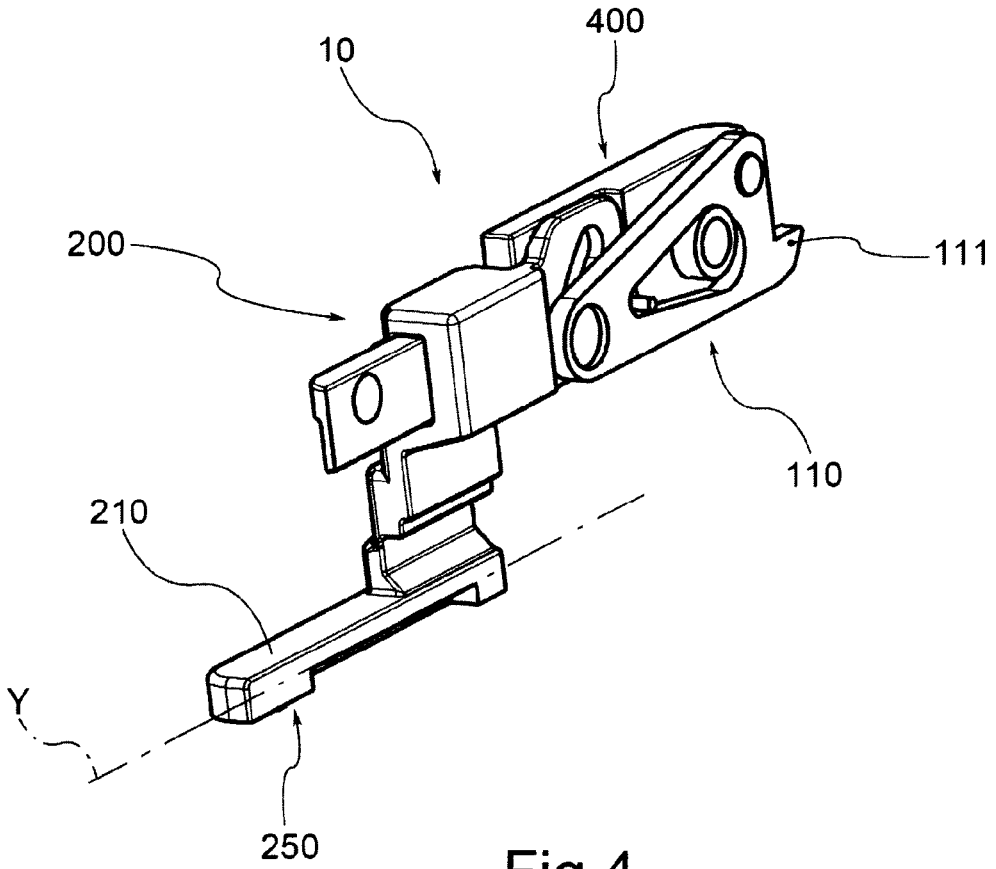
FIGS. 4 and 4*a* respectively show two perspective views of the detection device, the idler device and the support device, comprised in the detection system according to a preferred embodiment comprising a detection device of a bullet in the barrel.
Figure 4A:
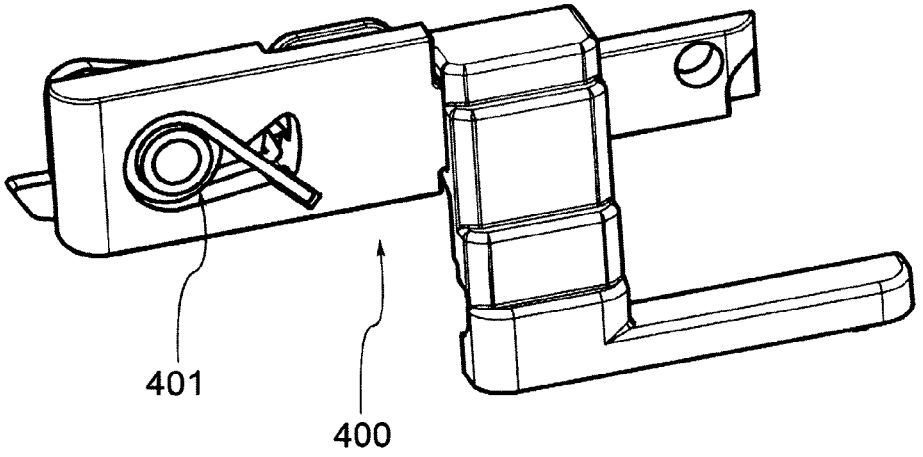
Figure 5:
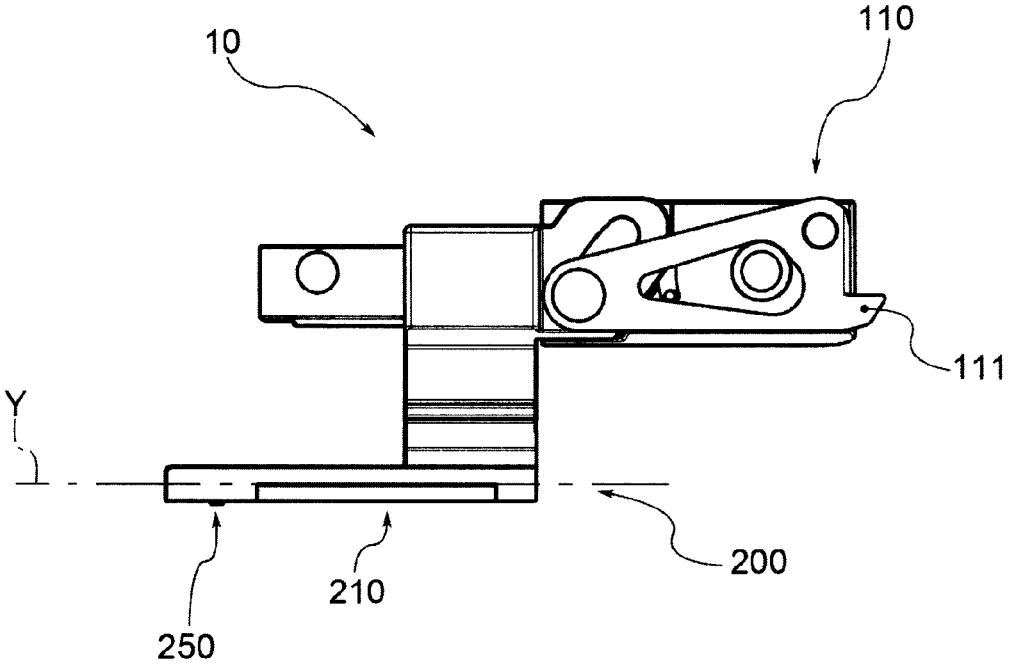
FIGS. 5 and 5*a* respectively show two side views of the detection device of the bullet in the barrel and of the idler device and the support device, according to FIGS. 4 and 4*a* respectively placed in an initial position and in a detection position.
Figure 5A:
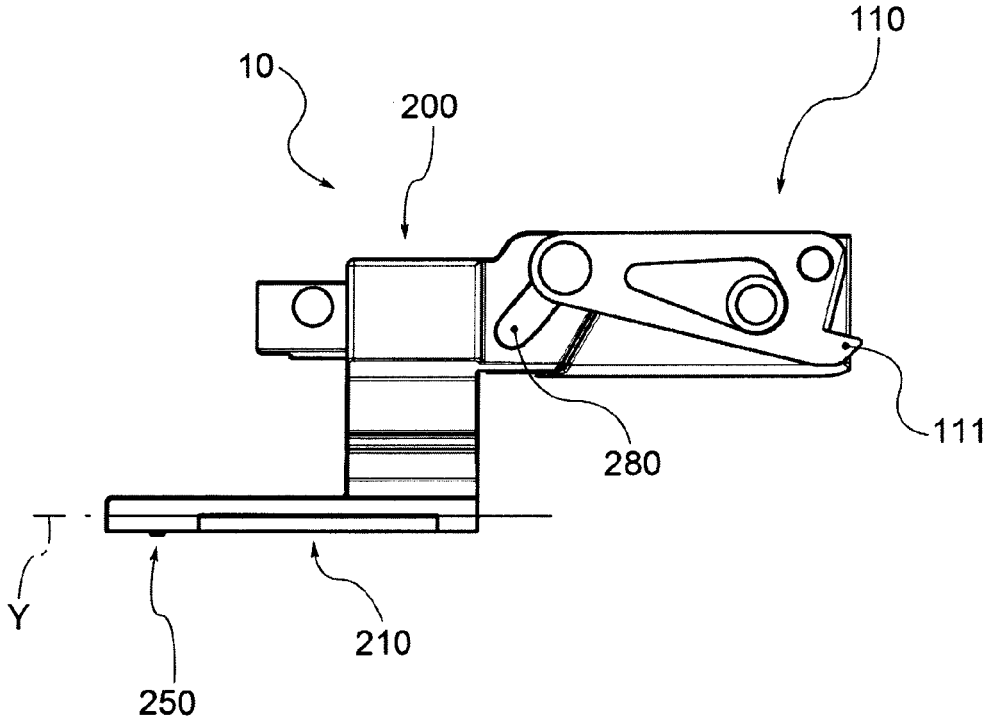
Figure 6:
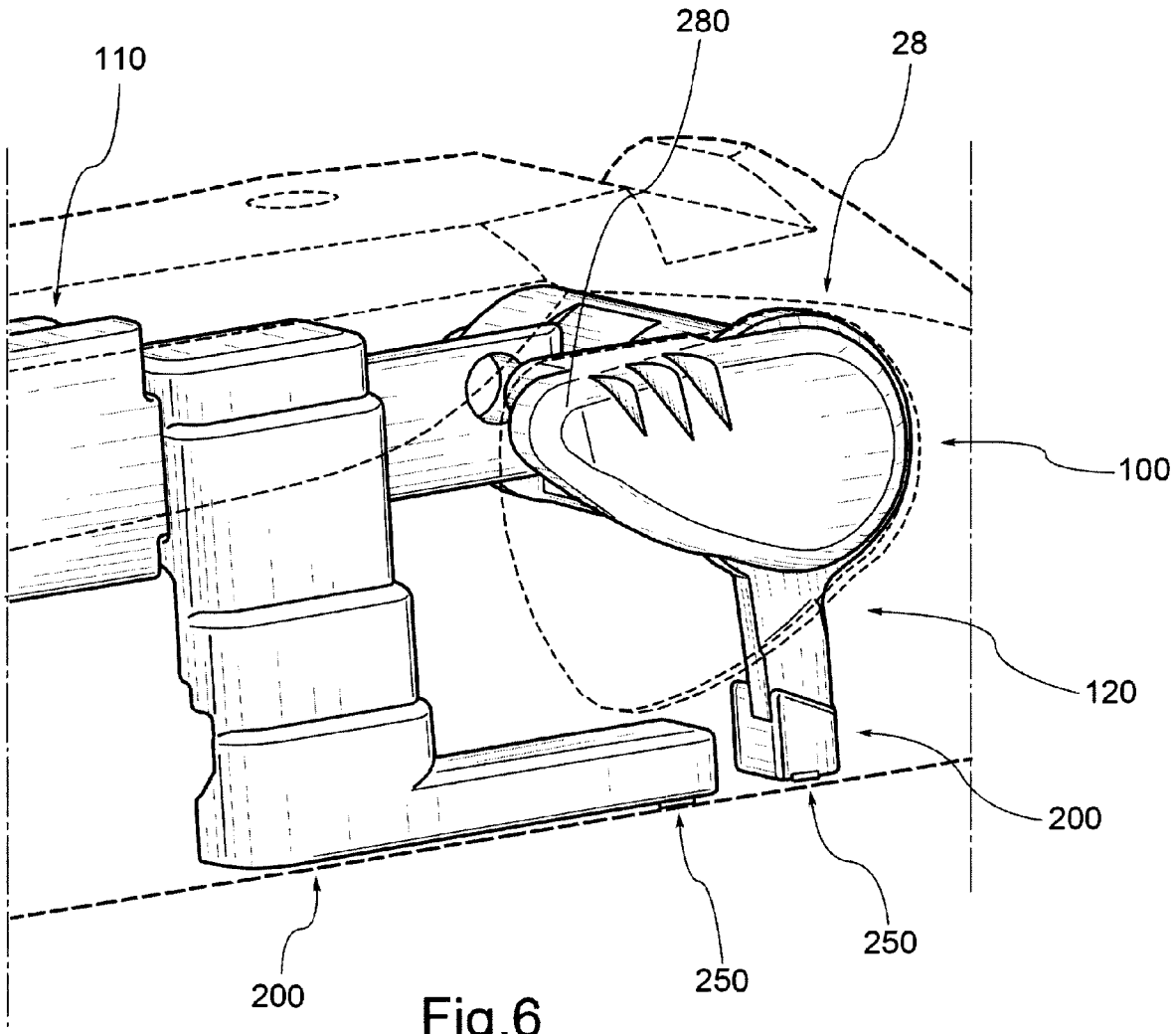
FIG. 6 shows a perspective view of the slide of the firearm shown in transparency, containing a part of the detection system comprised in the firearm according to the present invention, in which there is also a detection device of the release of the safety catch.
Figure 7:
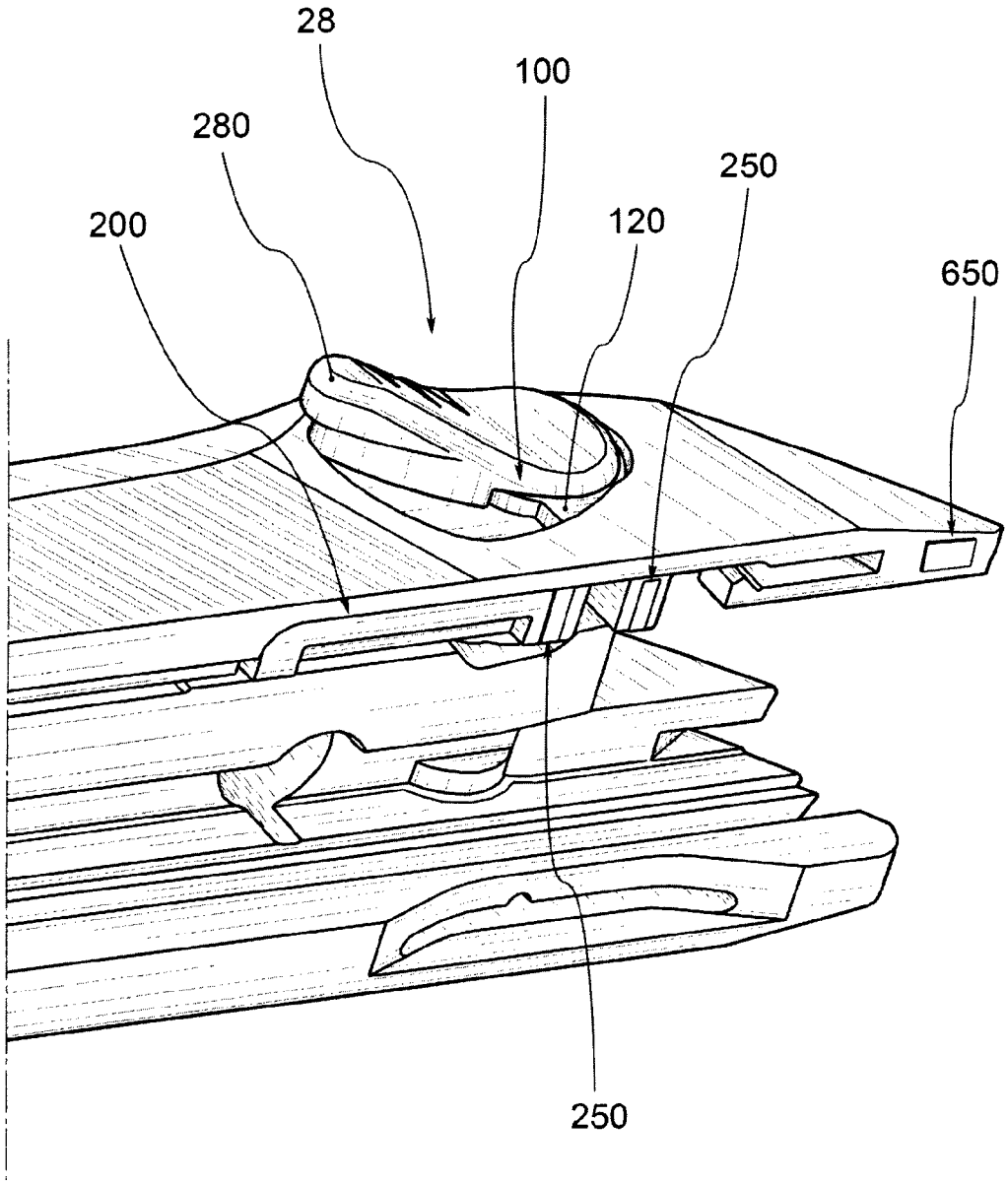
FIG. 7 is a perspective view from below of the slide of the firearm, containing a part of the detection system comprised in the firearm according to the present invention, in which a device for detecting the release of the safety catch and a detection device of a bullet in the barrel are present.
Figure 8:
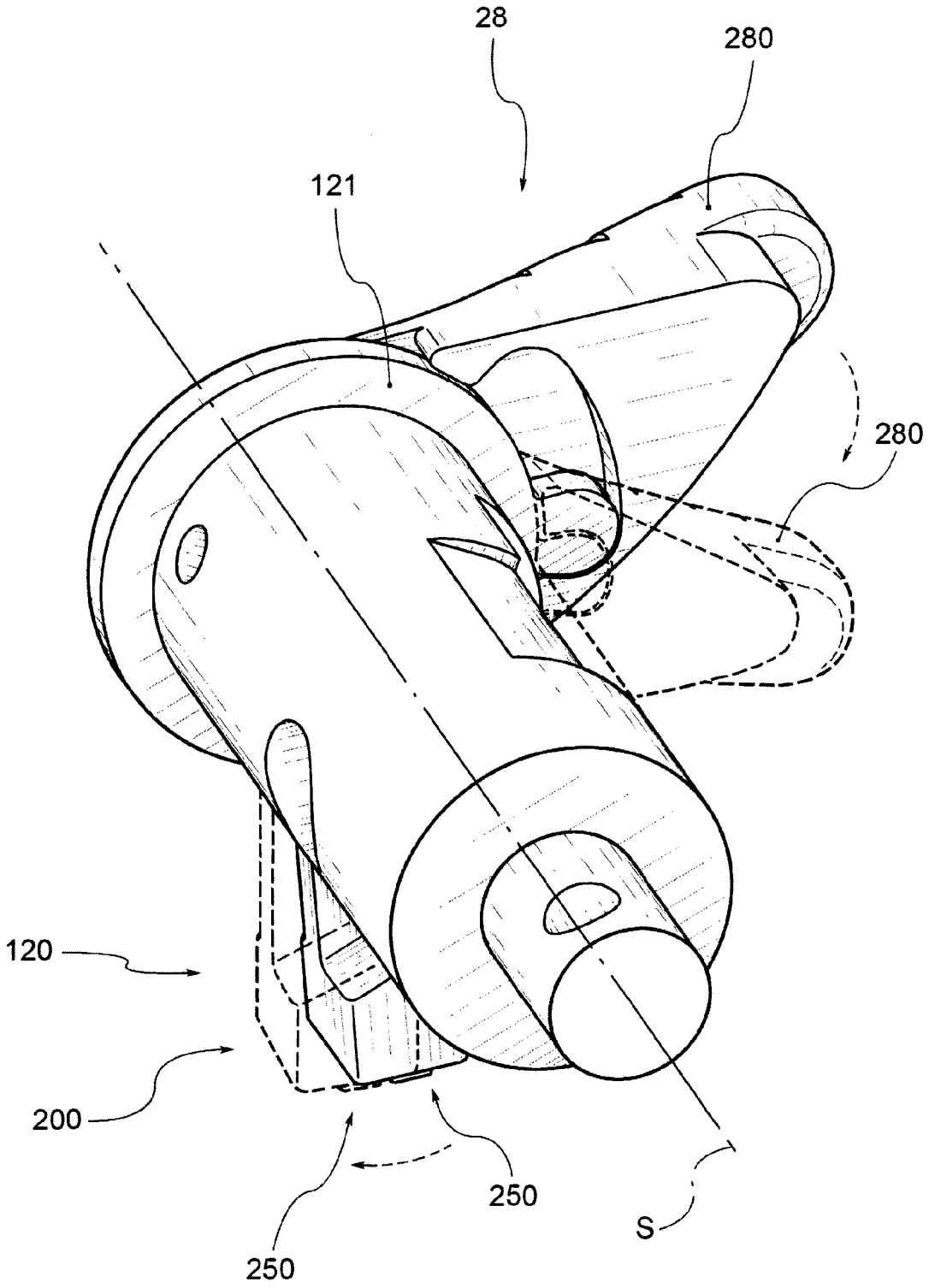
FIG. 8 shows a side perspective view of the detection device of the release of the safety catch according to FIGS. 7 and 8, respectively placed in an initial position and in a detection position.
Figure 9:
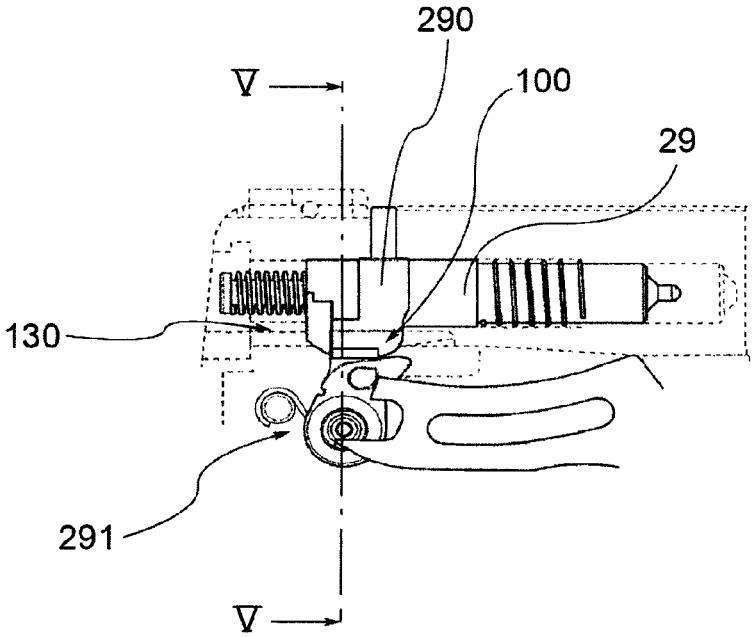
FIG. 9 shows a schematic representation of a portion of a firearm comprising a detection device comprising a detection device of locking of the firing pin and of the idler device and of the support device, according to a further embodiment.
Figure 9A:
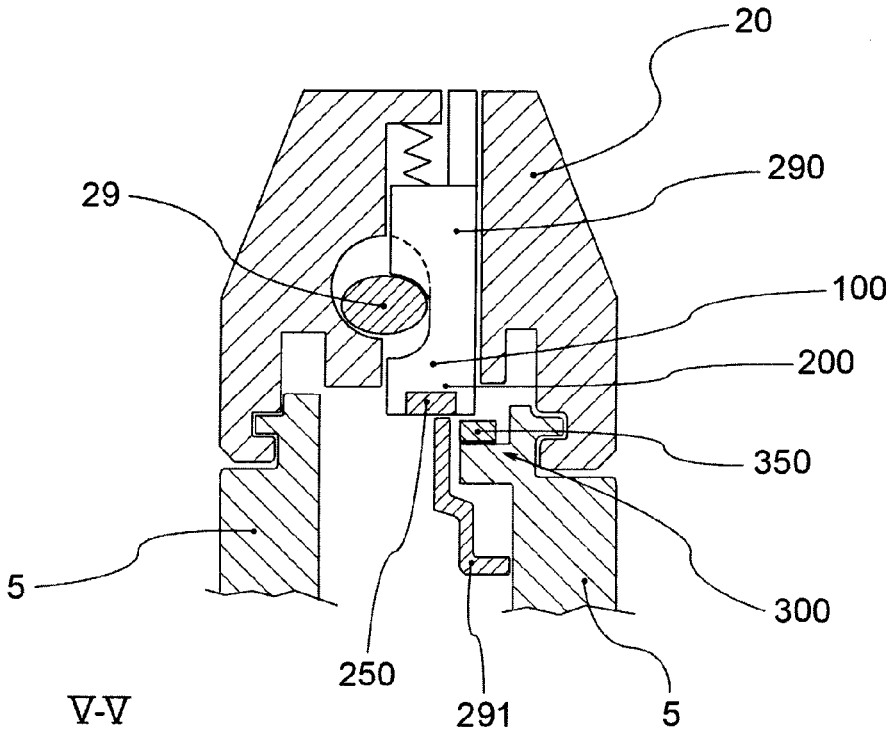
FIG. 9*a* shows a cross-section view of FIG. 9, along the cross-section plane V-V in FIG. 9.

With reference to the appended drawings, reference numeral 1 globally denotes a firearm in its entirety.

DETAILED DESCRIPTION OF THE PREFERRED EMBODIMENTS

Preferably, said firearm 1 comprises a main body 5, a barrel 2, which extends along a barrel axis X-X, and moving parts, such as a slide 20. Inside the barrel 2, the firearm 1 also has a cartridge chamber 21, the chamber which the bullet is placed and subsequently fired.

In a preferred embodiment said firearm 1 is a gun.

The firearm 1 according to the present invention comprises a detection system 10 suitable for detecting a configuration change of the firearm compared to its initial configuration. In other words, the detection system 10 is suitable to detect the presence or not of one or more changes in its configuration starting from an initial configuration in which it is not ready to fire, up to a configuration in which, instead, it is ready to fire.

Specifically, said detection system 10 is suitable to detect the configuration change and to manage such information for example sending an alert to the user of the firearm 1 or transmitting information remotely or storing the information.

In a preferred embodiment the detection system 10 further comprises a detection device 100 suitable to detect such configuration change of the firearm 1. In other words, the detection device 100 is movable from one position to another depending on the configuration change of the firearm. In a preferred embodiment, therefore, the detection device 100 is suitable to be placed in an initial position, corresponding to the initial configuration of the firearm 1, and a detection position, which corresponds to the new configuration which the firearm 1 is placed in.

According to a preferred embodiment, the detection device 100 comprises a detection device of a bullet in the barrel 110 suitable to detect the presence of a bullet in the cartridge chamber 21. The bullet with its presence in fact moves the detection device of the bullet in the barrel 110 from an initial position to a detection position. In other words, the detection device of the bullet in the barrel 110 comprises a detection portion 111 suitable to be positioned inside the cartridge chamber 21 and suitable to be moved by the bullet when it is positioned inside it. That is to say the detection device of the bullet in the barrel 110 is suitable to be positioned in an initial position in which said detection portion 111 is placed inside the cartridge chamber 21, and to be moved into a detection position of the bullet in the barrel which comes into contact with the detection portion 111 pushing it outside the cartridge chamber 21.

In a preferred embodiment the detection portion 111 is of such dimensions as not to be particularly invasive inside the cartridge chamber 21. Preferably, the detection portion 111 thus has the shape of a protrusion, preferably with a rounded tip, so as to make the contact with the bullet in the chamber more gradual.

Preferably, the detection portion 111 protrudes into said cartridge chamber 21 through a suitable opening made in the breech of the firearm 1; said opening consequently has suitable dimensions to permit the passage of said detection portion 111 without affecting the behaviour, specifically the firing inside the cartridge chamber 21, of the firearm 1. The presence of the bullet in the barrel thus entails that the detection portion 111 is pushed into the opening on the breech.

Preferably, the detection portion 111 protrudes inside the cartridge chamber by about 1 mm.

In a preferred embodiment, the detection device 100 comprises a detection device of the release of the safety catch 120, suitable to detect as a configuration change of the firearm 1, the release of the safety catch 28. The safety catch 28, in fact, moved by the user of the firearm 1, moves in turn the detection device 120 of the release of the safety catch from an initial position to a detection position. In other words, the detection device of the release of the safety catch 120 includes an engagement portion 121 engaging the safety lever 280 operable by the user. That is to say that the detection device of the release of the safety catch 120 is suitable for being positioned in an initial position in which the safety catch 28 is active, and suitable to be moved into a position of detection by the movement, translational and/or rotary, of the safety catch 28, for example by pressure on the safety lever 280.

According to a preferred embodiment, the detection device of the release of the safety catch 120 is suitable to rotate following the rotation of the safety catch 28, around its safety catch axis S-S. Preferably, the engagement between the engagement portion 121 and the safety lever 280 is such as to permit a controlled rotation of the detection device. In other words, a rotation of 60 degrees of the safety lever 280 corresponds to a rotation of 35 degrees of the engagement portion 121. In fact, preferably, the engagement between the engagement portion 121 and safety lever 280 is achieved by a means of a cam or link coupling. For example, in a preferred embodiment, the engagement portion 121 and the safety lever 280 are mutually engaged in such a way that an angle of rotation of the lever 280 is such that there is no interaction with the engagement portion 121, i.e. the lever 280 rotates alone, while at a second angle of rotation of the lever 280 this interacts with the engagement portion entailing its rotation in turn.

In a preferred embodiment, the detection device 100 comprises a detection device of locking of the firing pin 130, suitable to detect as a configuration change of the firearm 1, the release of the locking element of the firing pin 290 of the firearm 1. In a firearm, for example of the automatic type, for firing to take place, once the trigger is pressed, a kinematic chain of movements inside begins, among which the movement of the firing pin lock 290, which then allows the firing pin 29 to move freely to perform the explosion and fire. Preferably, in the initial firearm configuration, thus in the initial position of the detection device of locking of the firing pin 130, the firing pin 29 is locked by the firing pin locking element 290; when the trigger is pressed to perform firing, the firearm 1 changes configuration: thanks to a series of levers the firing pin locking element 290 is moved, for example vertically, upwards, to release the firing pin 29.

Preferably, the detection device of locking of the firing pin 130 comprises, in fact, a coupling portion operationally locked to the firing pin element 290, and thus for example translated following the movement thereof.

In a preferred embodiment the detection system 10 further comprises an idler device 200 engaged with the detection device 100.

Preferably said idler device 200 is driven, in turn, like the detection device 100, into an initial position and a detection position. In particular, said movement of the idler device 200 is a direct function of the movement of the detection device 100. In a preferred embodiment, for example the initial position of the detection device 100, for example of the detection portion 111, corresponds to an initial position of the idler device 200, and a detection position of the detection device 100, and in particular of the detection portion 111, corresponds to a detection position of the idler device 200.

In a preferred embodiment the idler device 200 comprises at least one primary sensor element 250, suitable to indicate the position assumed by said idler device 200. For example, the primary sensor element 250 is suitable to indicate the position of the idler device 200 as a function of the detection device 100 and thus of the configuration change of the firearm 1.

In a preferred embodiment, a translatory movement of the detection device corresponds to a translatory movement of the idler device. In further embodiments, a rotary movement of the detection device corresponds to a rotary movement of the idler device. However mixed embodiments are provided for in which the interaction, translatory or rotary, between the detection device and the idler device is variable, depending, for example, on their position inside the firearm, namely the first performs a movement in translation while the second performs it in rotation. Or again, embodiments are also provided for in which the movement itself of the devices is mixed, for example, being moved into rototranslation.

According to further preferred embodiments, instead, the detection device 100 and the idler device 200 are integrally connected to one another, for example being part of the same component, and thus perform a movement in unison. In other words, in some embodiments, solutions are also provided for in which the idler device 200 is integral with the detection device 100, for example in the case with the engagement portion 120 shown in the appended drawings, and thus the idler device 200 replicates the movement of the detection device 100.

In further embodiments, the idler device 200 is suitable to spatially multiply the movement of the detection device 100. In other words, the idler device 200 is suitable to perform a broader movement compared to the movement of the detection device 100. Instead in other embodiments, the idler device 200 is suitable to spatially reduce the movement of the detection device 100. In other words, the idler device 200 is suitable to perform a narrower movement compared to the movement of the detection device 100.

For example, in one embodiment, the detection device 100 is rotatable, performs a rotary movement, while, instead, the idler device 200 is translating, therefore when it is moved by the detection device 100 it performs a translatory, linear movement.

In a preferred embodiment the idler device 200 comprises a cam element 280, engaged with the detection device 100 in such a way as to be suitable to convert the rotary movement of the latter into a translatory movement of the idler device 200.

In a preferred embodiment the detection system 10 further comprises a support device 400 suitable to support the detection device 100 and the idler device 200.

Preferably, the detection device 100 is hinged to the support device 400, for example on a pin provided.

Preferably moreover the idler device 200 is suitable to translate along the support device 400.

Again, in a further preferred embodiment, the support device 400 comprises an elastic element 401 engaging the detection device 100 to keep it in an initial position.

For example, applied to the detection device of the bullet in the barrel 110, the elastic element 401 in keeping this initial position thus keeps the detection portion 111 inside the cartridge chamber 21, protruding from the breech. This way when the bullet is placed in the cartridge chamber 21 it overcomes the resistance of the elastic element 401 pushing the detection portion 111 and thus the detection device of the bullet in the barrel 110 into the detection position. Since the idler device 200 is engaged with the detection device of the bullet in the barrel 110, the elastic element 401 keeps it, in turn, in an initial or detection position depending on the embodiment.

In a preferred embodiment the support device 400 is housed on the slide 20 of the firearm 1, and is therefore suitable to engage the detection device 100 and the idler device 200 with said slide 20.

In a preferred embodiment the detection system 10 comprises a receiver device 300 suitable to receive the information of the configuration change of the firearm 1 upon the signalling of the detection device 100, that is, of the idler device 200, thus of the primary sensor element 250.

Preferably, said receiver device 300 after receiving the information of the configuration change or not is suitable to manage such information, for example alerting the user of the firearm 1 by suitable signalling means and/or by storing the information or transmitting it, sending it remotely; preferably, said signalling means of the bullet in the barrel are suitable to produce an acoustic or visual type signal indicating the information desired. In a preferred embodiment, said signalling means are on the firearm itself, or in other embodiments are located remotely. Preferably said means of signalling the presence of the bullet in the barrel may be remote from the firearm and receive the information after sending thereof.

Preferably, the receiver device 300, in order to receive the information of the presence of the bullet in the barrel or not comprises at least one secondary sensor element 350.

Preferably, the primary sensor element 250 and secondary sensor element 350 are magnetically sensitive to one another.

Therefore, depending on the mutual position thereof, the secondary sensor element 350 is suitable to receive, since magnetically solicited by the primary sensor element 250, information of the position of the idler device 200.

Preferably, the primary sensor element 250 is a ferromagnetic element while the secondary sensor element 350 is sensitive to the magnetic field, as is for example an electrical coil, or again a ferromagnetic element.

In a further embodiment, the secondary sensor element 350 is of the mechanical type: in other words the secondary sensor element 350 is a mechanical switch. The secondary sensor element 350, in fact, contains a lamella which when magnetically solicited is suitable to move and thus close an electrical circuit, thereby transmitting the information.

In a preferred embodiment the idler device 200 comprises two of the primary sensor elements 250 and/or the receiver device 300 comprises two secondary sensor elements 350, wherein the two primary sensor elements 250 and/or two secondary sensor elements 350 are positioned staggered with each other; or in further embodiments said pairs of sensors are distanced from each other by a predefined distance, in the direction of movement of the idler device 200.

Preferably, this way, the receiver device 300 by means of the secondary sensor element 350, is suitable to be influenced by the presence of one or more secondary sensor elements 250 depending on the position of the latter.

Or in other embodiment variants, the receiver device 300 comprises two secondary sensor elements 350, influenced, for example, simultaneously, by the presence of at least one primary sensor element 250.

For example in a configuration in which the detection device 100 is in the initial position, a primary sensor element 250 is positioned between two secondary sensor elements 350 and/or a secondary sensor element 350 is positioned between two primary sensor elements 250. Subsequently, when the detection device 100 is moved to the rearward position the primary sensor element 250, first positioned between two secondary sensor elements 350, moves so as to influence only one of said secondary sensor elements 350; and similarly, in the other embodiment variant, the secondary sensor element 350, first positioned between two primary sensor elements 250, is influenced by only one of said primary sensor elements 250 and no longer by both.

In fact, depending on the embodiment variants, and the number of sensor elements comprised in the detection system 10, the receiver device 300 is calibrated according to the type of the magnetic fields to which the respective secondary sensor element or elements 350 is or are magnetically sensitive.

In a preferred embodiment, the idler device 200 comprises a sensor support portion 210, on which the primary sensor element 250 is housed which extends along a secondary axis Y-Y parallel to the barrel axis X-X. Preferably, the idler device 200 is suitable to translate along said secondary axis Y-Y.

Preferably, the at least one primary sensor element 250 and/or the at least one secondary sensor element 350 is positioned along said secondary axis Y-Y.

In particular, according to a preferred embodiment, the receiver device 300 is placed on the main body of the firearm 5 and the detection device 100 and the idler device 200 are positioned on the slide 20 of the firearm 1.

Specifically, according to said embodiment the primary sensor element 250 is housed on the slide 20 facing the main body 5, and the secondary sensor element 350 is housed on the main body 5 facing the slide 20. This way, the two sensor elements are suitable to influence one another magnetically.

Preferably, therefore the sensor support element 210 is placed on the slide 20 facing the main body 5. In a preferred embodiment, therefore, said sensor 210 support element extends along the slide 20.

Furthermore, the detection system 10 comprises a slide position device 600 comprising a primary slide sensor element 650 housed in a fixed manner on the slide 20, and thus translating therewith along the barrel axis X-X. The receiver device 300 comprises, on the main body 5, a secondary slide sensor element 356. The two elements are magnetically sensitive to one another, according to the embodiments already described above. This way the movement of the slide 20, the receiver device 300, and in particular its secondary slide sensor element 365, is magnetically solicited by the variation of the magnetic field due to the primary slide sensor element 650 moved.

According to the above description, and according to the type of sensor elements comprised in the firearm, it is to be noted that in some embodiments, both in the initial configuration and in the detection configuration said sensor elements are mutually influenced by one another; however, following the configuration change of the firearm a change of said mutual influence takes place, for example as a result of the change in intensity of the magnetic field, this change is thus detected by the respective detection device as the configuration change.

Innovatively the firearm of the present invention resolves the typical drawbacks of the prior art, comprising a non-invasive detection system, specifically suitable to not influence the design, production, or reciprocal movement between the slide and the main body.

Advantageously, in fact, the detection system comprises sensor elements suitable to communicate with each other, sending each other information without revolutionising the structure of the firearm, inasmuch as magnetically sensitive to each other.

In addition, advantageously, a part of the detection device is positioned on the slide, while the other part is positioned in the main body of the firearm; this way the components mounted on the slide are of small dimensions and do not affect its movement, while the components of greater dimensions can be situated on the main body of the firearm. As mentioned, however, the various components housed on different bodies communicate with each other in a wireless mode, without a material type connection, using the magnetic sensitivity of the various sensors.

According to a further advantageous aspect, the firearm of the present invention has the same characteristics of dismantling, with the same phases, present on a similar firearm without the detection system; this is made possible thanks to the fact that the detection system, between the mobile masses and fixed masses, does not provide for any connection of a material type.

According to another further advantageous aspect, the primary sensor element and secondary sensor element respectively face one another on the slide and the main body so as to reciprocally influence each other magnetically.

Advantageously, the management of the magnetic interaction mode between the components is of simple construction, for example comprising at least one of the two sensor elements as a ferromagnetic element therefore suitable to have a specific magnetic field and the other as a magnetically sensitive element, being in turn a magnet, or an electrical circuit being influenced by said magnetic field, or being any other type of magnetically sensitive elements or being a "hybrid system" comprising more than one of said characteristics.

Advantageously, the detection system comprises a variable number of sensor elements according to the various embodiments, this way such embodiments are particularly advantageous in that they use the destructive and/or constructive interference of the magnetic fields of the elements including the sensors.

According to a further advantageous aspect, the idler device is suitable to transform and multiply or reduce the movement of the detection device, thus minimising the invasiveness of the detection portion in the cartridge chamber.

According to yet a further advantageous aspect, the non-invasiveness of the detection system of the present invention makes it applicable to firearms of small dimensions, such as guns.

Advantageously, the detection system is suitable, depending on the type of the specific detection devices present on the firearm, to detect a multiplicity of configuration changes of the firearm, and then to store or transmit only some of these or a combination thereof.

Further embodiments of the firearm of the present invention provide for a variable number or mutual positioning of the various sensor elements, both primary and secondary, so as to detect more precisely the presence of the bullet in the barrel and/or of the obturator.

Embodiment variants provided for further comprise solutions in which the firearm, by suitable means, is prevented or not from firing depending on the findings of the detection system.

Moreover, in further embodiment variants, the magnetic interaction between the various sensors induces a movement of some in relation to others; for example, in one embodiment the magnetic interaction may induce the primary or the secondary sensor element to move under the effect of the aforesaid magnetic field induced.

In further embodiment variants the primary and/or secondary sensor elements are magnetically sensitive exploiting the Hall effect, thus presenting electrical circuits more or less sensitive to magnetic fields, or more or less reproducible magnetic fields.

It is clear that a person skilled in the art may make modifications to the firearm described above so as to satisfy contingent requirements while remaining within the sphere of protection of the following claims.

The invention claimed is:

1. A firearm comprising a main body, a barrel, a slide, and a detection system suitable to detect a configuration change of the firearm from an initial configuration, wherein said detection system comprises:

a detector, housed on board said slide, suitable to be positioned in an initial position corresponding to the initial configuration of the firearm, and suitable to be moved into a detection position in which the detector detects a configuration change of the firearm, the configuration change of the firearm comprising release of a safety catch;

an idler, housed on board said slide, engaged with the detector and moved into an initial position and a detection position according to movement of the detector, wherein the idler comprises a primary sensor;

a receiver housed on board said main body suitable to receive information of the configuration change of the firearm depending on a position of the primary sensor comprising a secondary sensor;

wherein the primary sensor and the secondary sensor are magnetically sensitive to one another.

2. The firearm according to claim 1, wherein the detector is rotatable and the idler is translatable or wherein the detector is rotatable and the idler rotatable.

3. The firearm according to claim 1, wherein the detector comprises a bullet detector suitable to detect a presence of a bullet in a cartridge chamber of the firearm, comprising a detection portion which, in the initial position of the detector, is placed inside said cartridge chamber, and is movable into a detection position of the bullet in the barrel, corresponding to the detection position of the detector.

4. The firearm according to claim 1, wherein the detector comprises a release detector suitable to detect release of the safety catch of the firearm, comprising an engagement portion engaging a safety lever controllable by a user, wherein in the initial position of the detector, the safety catch is inserted, and is movable into a translated and/or rotated position by the release of the safety catch, corresponding to the detection position of the detector.

5. The firearm according to claim 1, wherein the detector comprises a locking detector, suitable to detect release of a lock of the firing pin of the firearm, comprising a coupling portion operationally locked to the lock of the firing pin, wherein in the initial position of the detector, the firing pin is locked by the lock, and is movable in translation into a release position, by the release of the lock of the firing pin controlled by an action of a user on a trigger, corresponding to the detection position of the detector.

6. The firearm according to claim 1, wherein the idler comprises a sensor support portion suitable to house the primary sensor.

7. The firearm according to claim 6, wherein the primary sensor and/or the secondary sensor are/is positioned along a secondary axis.

8. The firearm according to claim 1, wherein the detection system further comprises a slide positioner comprising a primary slide sensor housed in a fixed manner on the slide and wherein the receiver comprises a secondary slide sensor, wherein the primary slide sensor and secondary slide sensor are magnetically sensitive to one another.

9. The firearm according to claim 1, wherein the idler comprises two primary sensors and/or the receiver comprises two secondary sensors, wherein the two primary sensors and/or the two secondary sensors are positioned staggered from each other in a direction of movement of the idler.

10. The firearm according to claim 9, wherein, in a configuration in which the detector is in the initial position, one of the primary sensors is positioned between the two secondary sensors and/or one of the secondary sensors is positioned between the two primary sensors.

11. The firearm according to claim 1, wherein the primary sensor is housed on the slide facing the main body, and the secondary sensor is housed on the main body facing the slide.

12. The firearm according to claim 1, wherein the detection system comprises a support suitable for supporting the detector and the idler, the support engaging the detector and the idler with the slide.

13. The firearm according to claim 12, wherein the detection system is hinged to the support.

14. The firearm according to claim 12, wherein the idler is suitable to translate or rotate along the support.

15. The firearm according to claim 12, wherein the support comprises an elastic element engaging the detector to keep the detector in the initial position.

16. The firearm according to claim 3, wherein the receiver comprises a signaller of the bullet in the barrel suitable to signal to a user presence or absence of the bullet in the barrel.

17. The firearm according to claim 1, wherein said firearm is a gun.

18. The firearm according to claim 1, wherein the idler comprises a sensor support portion suitable to house the primary sensor and to extend along a secondary axis parallel to a barrel axis along which the barrel extends.

* * * * *